US010297927B2

(12) United States Patent
Amadjikpe

(10) Patent No.: US 10,297,927 B2
(45) Date of Patent: May 21, 2019

(54) ANTENNA PACKAGE FOR LARGE-SCALE MILLIMETER WAVE PHASED ARRAYS

(71) Applicant: Intel Corporation, Santa Clara, CA (US)

(72) Inventor: Arnaud Lucres Amadjikpe, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 187 days.

(21) Appl. No.: 15/583,859

(22) Filed: May 1, 2017

(65) Prior Publication Data

US 2018/0316098 A1 Nov. 1, 2018

(51) Int. Cl.

| | |
|---|---|
| ***H01Q 1/38*** | (2006.01) |
| ***H01Q 21/22*** | (2006.01) |
| ***H01Q 9/04*** | (2006.01) |
| ***H01Q 21/06*** | (2006.01) |
| ***H01Q 19/00*** | (2006.01) |

(52) U.S. Cl.

CPC ..... *H01Q 21/22* (2013.01); *H01Q 1/38* (2013.01); *H01Q 9/045* (2013.01); *H01Q 9/0414* (2013.01); *H01Q 9/0457* (2013.01); *H01Q 19/005* (2013.01); *H01Q 21/065* (2013.01)

(58) Field of Classification Search

CPC ..... H01Q 21/22; H01Q 1/38; H01Q 9/0414; H01Q 9/045; H01Q 9/0457; H01Q 19/005; H01Q 21/065

See application file for complete search history.

(56) References Cited

U.S. PATENT DOCUMENTS

2005/0110686 A1 5/2005 Frederik Du
2011/0025574 A1 2/2011 Tiezzi et al.
(Continued)

OTHER PUBLICATIONS

"European Application Serial No. 18168853.2, Extended European Search Report dated Sep. 27, 2018", 11 pgs.
(Continued)

*Primary Examiner* — Dameon E Levi
*Assistant Examiner* — David E Lotter
(74) *Attorney, Agent, or Firm* — Schwegman Lundberg & Woessner, P.A.

(57) ABSTRACT

A multilayer package and wireless communication device for high frequency communications, for example large-scale millimeter (mmWave) phased arrays having wide scanning range, wide bandwidth, and high efficiency. The multilayer package comprises a plurality of patch antennas disposed on a first substrate, a plurality of slotted patch antennas disposed on a third substrate, the first substrate and the third substrate being disposed on opposing sides of a second substrate, a plurality of antenna feeds disposed on a fourth substrate, the fourth substrate being disposed adjacent to the third substrate, a plurality of dipoles disposed on the first substrate, the second substrate, the third substrate, and the fourth substrate, and an impedance transformer, disposed within one or more additional substrates. The wireless communication device can include the multilayer package and an integrated circuit, wherein each of the plurality of antenna feeds is coupled to the integrated circuit by the impedance transformer.

21 Claims, 12 Drawing Sheets

(56) References Cited

U.S. PATENT DOCUMENTS

| | | | | |
|---|---|---|---|---|
| 2012/0212384 | A1* | 8/2012 | Kam | H01Q 1/2283 343/767 |
| 2016/0190697 | A1 | 6/2016 | Preradovic et al. | |
| 2018/0159203 | A1* | 6/2018 | Baks | H01Q 1/2283 |

OTHER PUBLICATIONS

Mathur, Pratigya, et al., "Non-Radiating Edge Coupled Rectangular Microstrip Antenna array", 2016 Asia-Pacific Microwave Conference (APMC), IEEE, (Dec. 5, 2016), 1-4 pgs.

* cited by examiner

ANTENNA PACKAGE FOR LARGE-SCALE MILLIMETER WAVE PHASED ARRAYS

TECHNICAL FIELD

Aspects of the present disclosure relate to the field of phased array antennas and in particular to methods and apparatus for packaging large-scale millimeter wave phased array antennas.

BACKGROUND

Several challenges exist in designing wideband, wide scanning, and high-efficiency printed antenna phased arrays that concurrently meet requirements of wide scanning range, wide bandwidth, and high efficiency. One particular challenge exists with respect to impedance bandwidth. Because of ground plane proximity, energy may be stored between a radiating printed antenna (e.g., patch antenna) and a prospective ground plane. Surface wave modes, supported by grounded dielectrics, can be responsible for a "scan blindness" phenomenon. In particular, a scanning null emanating from excitation of the zero cutoff frequency $TM_0$ surface mode moves toward broadside as the dielectric thickness increases. An additional challenge with large printed antenna arrays is the efficiency loss experienced by utilizing a transmission line feed network between a port of a die (e.g., radiofrequency integrated circuit) and an antenna. In some aspects, certain large millimeter wave antenna arrays may experience efficiency losses in 50Ω stripline feed networks on the order of several decibels. A major contributor to these losses is the conductor (e.g., copper) surface roughness.

DESCRIPTION OF ASPECTS

To address challenges existing in designing printed antenna arrays having wide bandwidths, thicker substrates have been adopted in combination with stacked resonators to broaden the bandwidth of certain printed antennas. A thicker substrate between stacked resonators can generally result in a wider effective bandwidth of an antenna element, however, an increase in substrate thickness may also give rise to scanning nulls in the field of view of a printed phased array. Further, to address challenges with respect to surface mode propagation, radiating elements previously have been surrounded with electromagnetic band gap structures that exhibit a stop band behavior with respect to the surface modes. However, such structures may not be adequate for closely spaced (e.g., $\lambda/2$) phased array elements, because they may couple to the fringing fields of the radiating printed antenna elements, thereby limiting the effective bandwidth as well as radiation efficiency of the antenna array.

With respect to efficiency losses in transmission lines, even low-loss substrate materials would only marginally improve stripline losses because the metal surface roughness tend to dominate the ohmic loss mechanisms. Further, large printed circuit board packages (e.g., on the order of 10 cm×10 cm) may increase warpage impacts on the reliability of die-to-package assembly and also the phase relationship between elements at the edge or at the center of the array. Dummy metal patterns are traditionally added on metal layers of multilayered packages to balance the metal density throughout the stack-up, however inadequate dummy metal patterns surrounding a radiating element may resonate and thus significantly alter the antenna radiation pattern and efficiency.

Aspects described herein address such challenges and include a multilayer antenna package for high frequency communications, for example large-scale millimeter (mm-Wave) phased arrays having wide scanning range, wide bandwidth, and high efficiency. Applications of the multilayer antenna package can include multi-gigabit communication systems, for example 5th Generation (5G) mobile networks.

Figure 1A:
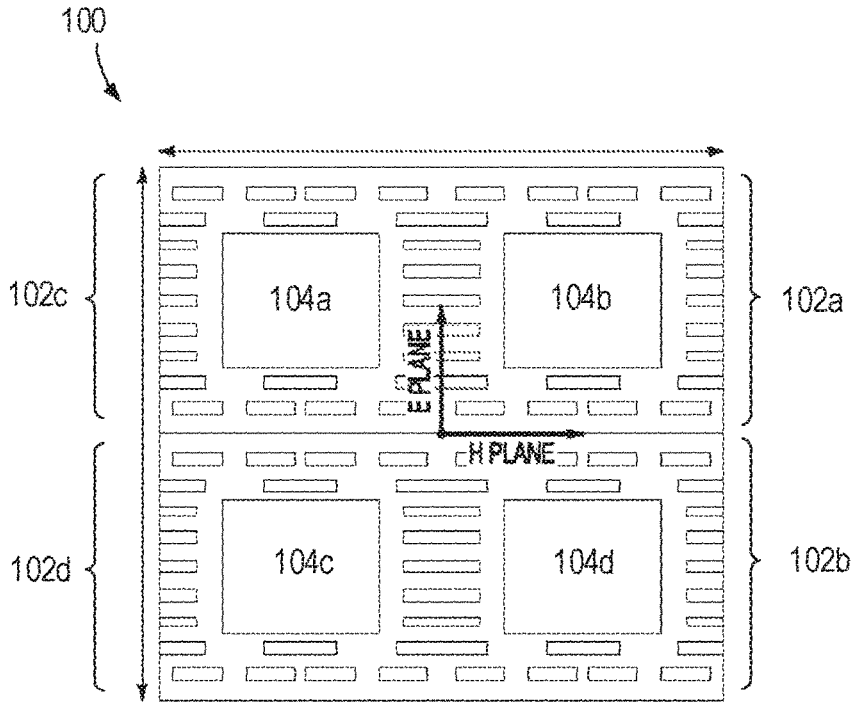
FIG. 1A illustrates a block diagram of a top view of an exemplary subarray antenna package unit cell, according to some aspects.

FIG. 1A illustrates a top view of an exemplary subarray antenna package unit cell 100, including in some aspects, one or more subarray elements (e.g., four subarray elements 102*a*-102*d*). In some aspects, each subarray element includes a resonant patch antenna (e.g., one of resonant patch antennas 104*a*-104*d*), a slotted resonant patch antenna (not shown), an antenna feed (not shown), an impedance transformer (e.g., coaxial. impedance transformer 114 in FIG. 1D), and a plurality of dipoles (e.g., non-resonant dipoles described in further detail below with respect to FIG. 3). In some aspects, the subarray antenna package unit cell 100 includes a 2×2 array of subarray elements, wherein each subarray element is coupled to one of a plurality of ports of an integrated circuit, for example a radiofrequency integrated circuit (RFIC) (e.g., one out of four RFIC ports and bump interface 106 in FIG. 1B), through an impedance transformer (e.g., coaxial impedance transformer 114 in FIG. 1D).

Figure 1B:
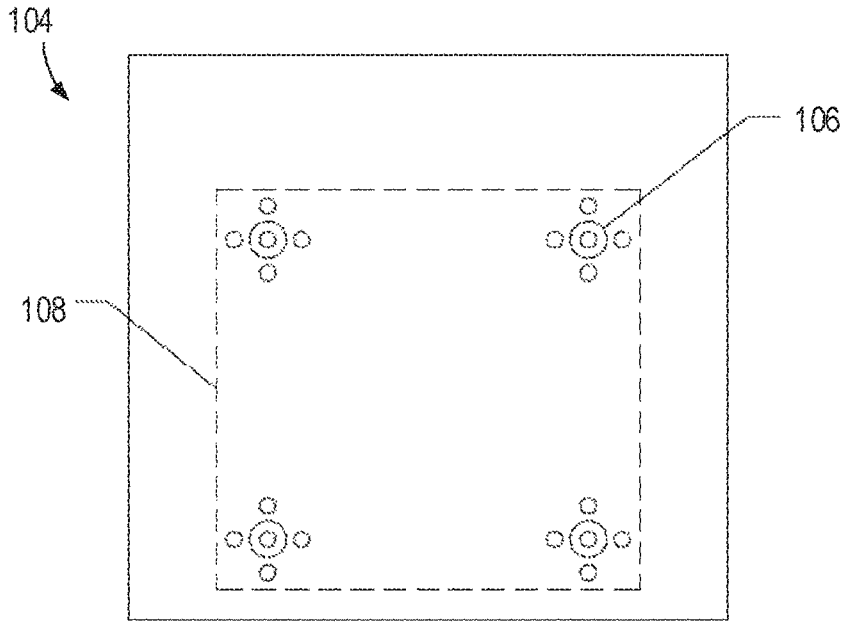
FIG. 1B illustrates a block diagram of an exemplary placement of an integrated circuit with respect to a subarray antenna package unit cell, according to some aspects.
Figure 1C:
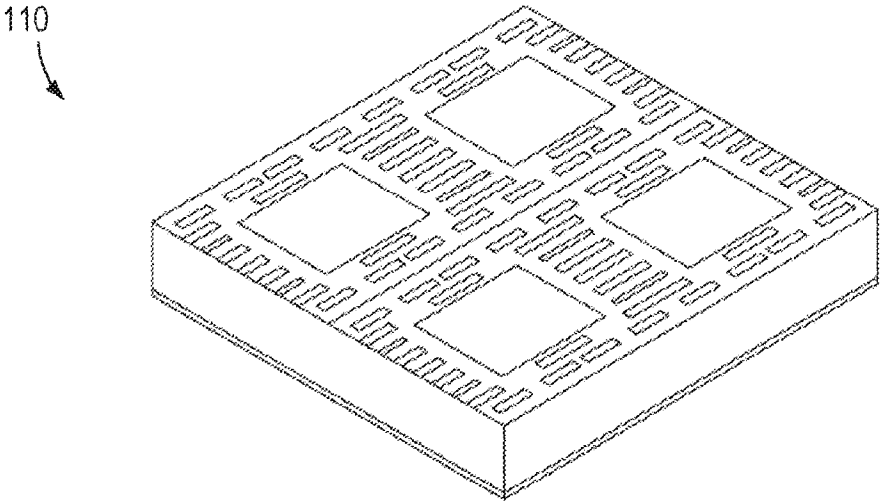
FIG. 1C illustrates a block diagram of a top diagonal view of an exemplary subarray antenna package unit cell, according to some aspects.
Figure 1D:
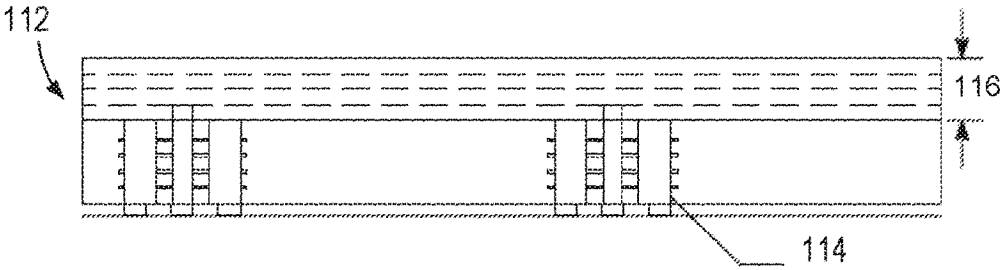
FIG. 1D illustrates a block diagram of a cross-sectional view of an exemplary subarray antenna package unit cell, according to some aspects.

FIG. 1B illustrates an exemplary placement of an integrated circuit (e.g., 2×2 RFIC die outline 108) with respect to an exemplary subarray antenna package unit cell 100. In some aspects, each subarray element (e.g., each of subarray elements 102*a*-102*d*) is coupled to one out of a plurality of ports of an RFIC (e.g., one out of four RFIC ports and bump interface 106). Similar to FIG. 1A, FIG. 1C illustrates a top diagonal view of an exemplary subarray antenna package unit cell (e.g., subarray antenna package unit cell 100), including in some aspects, one or more subarray elements (e.g., subarray elements 102*a*-102*d*). FIG. 1D illustrates a cross-sectional view 112 of an exemplary subarray antenna package unit cell 100. In some aspects, the subarray antenna package unit cell 100 includes a coaxial impedance transformer 114 disposed between a plurality of substrate layers (e.g., substrate layers 320 described below with respect to FIG. 3). In some aspects, the subarray antenna package unit cell 100 includes a plurality of substrate layers 116 that include one or more resonant patch antennas (e.g., resonant patch antennas 104*a*-104*d*), one or more slotted resonant patch antennas, one or more antenna feeds, and a plurality of dipoles (e.g., non-resonant dipoles), further described below with respect to FIG. 3.

Figure 2:
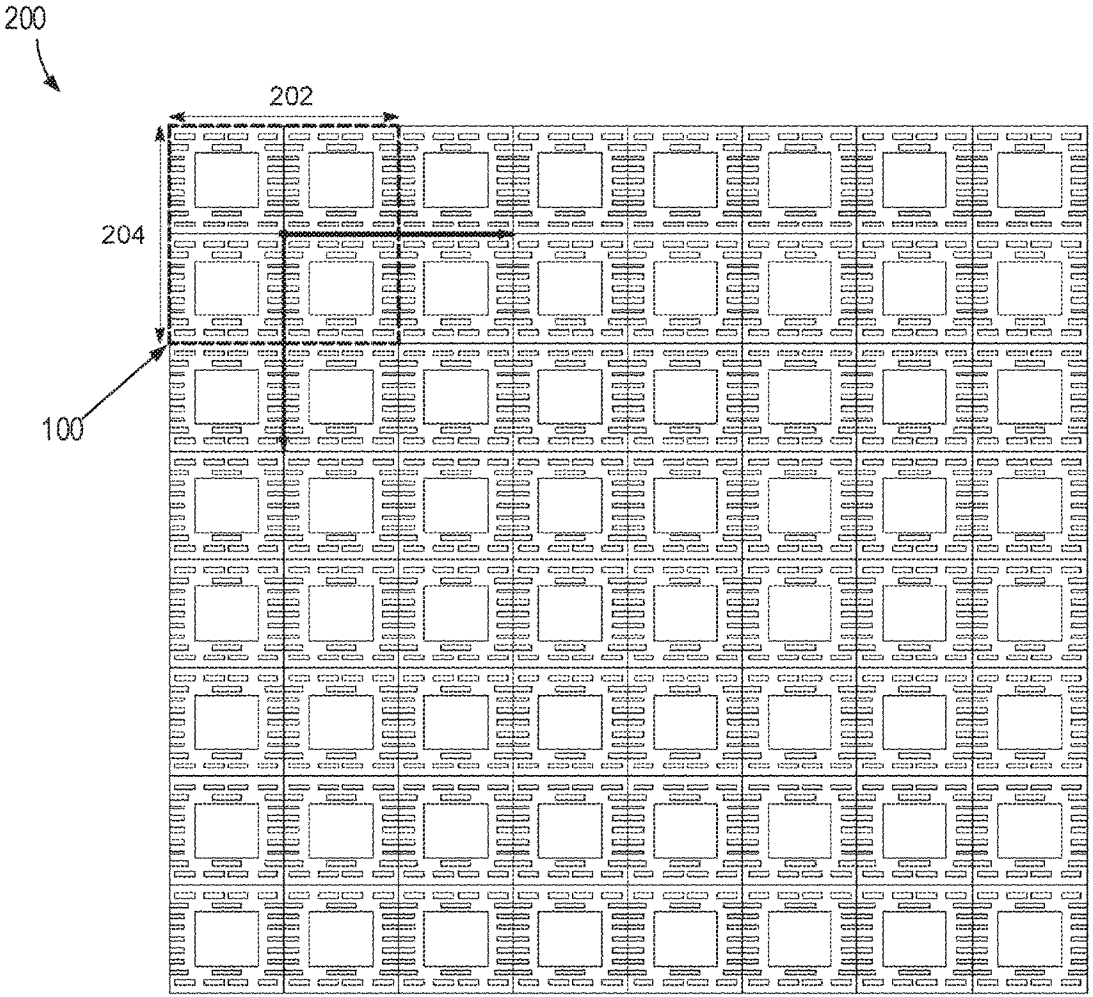
FIG. 2 illustrates a block diagram of an exemplary antenna array, according to some aspects.

FIG. 2 illustrates a block diagram of an exemplary antenna array 200, according to some aspects. In some aspects, the antenna array 200 is a large-scale millimeter wave phased array antenna, including a plurality of subarray antenna package unit cells (e.g., subarray antenna package unit cell 100) similar to the subarray antenna package unit cell of FIG. 1A. In some aspects, the antenna array 200 includes an arrangement of subarray antenna package unit cells that are arranged in a tiled configuration, including any number of multiples of subarray antenna package unit cells (e.g., 4×4, 8×8, and 16×16). Associated with each subarray antenna package unit cell (e.g., subarray antenna package unit cell 100), is a particular electric plane (E-plane) pitch 204 and a particular magnetic plane (H-plane) pitch 202.

Figure 3:
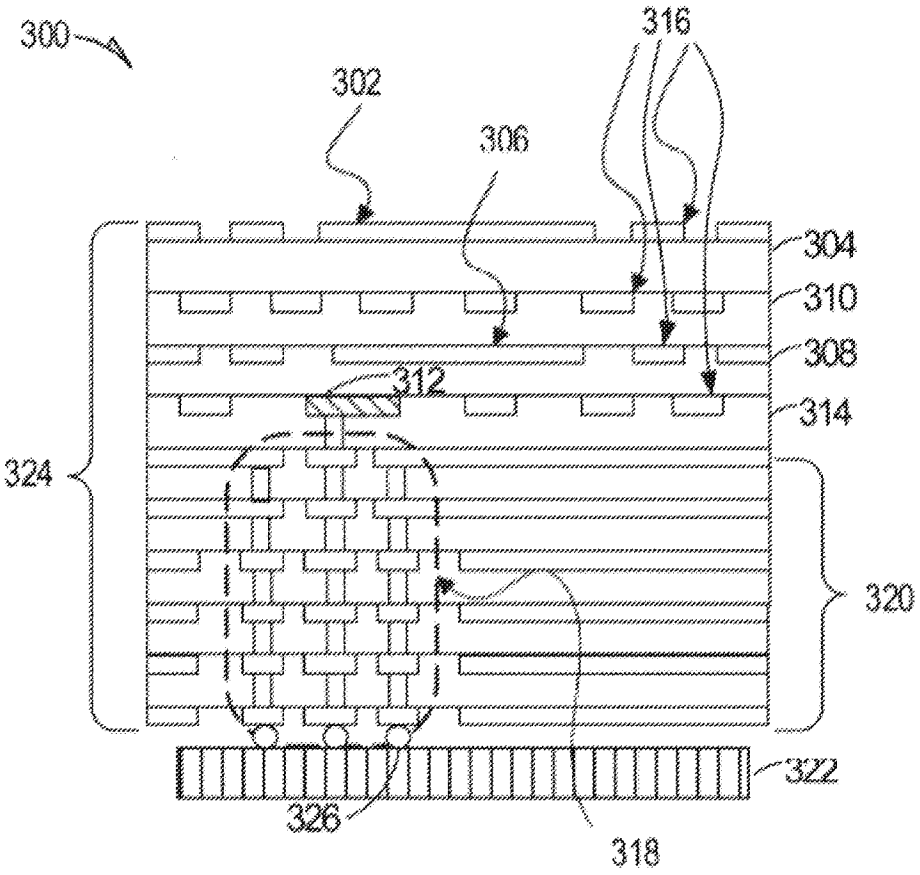
FIG. 3 illustrates a block diagram of stack up of an exemplary antenna device, according to some aspects.

FIG. 3 illustrates a block diagram of stack up of an exemplary antenna device, according to some aspects. In some aspects, the antenna device 300 is a subarray antenna package unit cell. The antenna device 300 comprises a resonant patch antenna (e.g., resonant patch antenna 302), disposed on a substrate layer of the antenna device 300 (e.g., on an outer side of substrate layer 304 of the antenna device 300), a slotted resonant patch antenna (e.g., slotted resonant patch antenna 306), disposed on a middle substrate layer (e.g. substrate layer 308), an additional substrate layer (e.g., substrate layer 310) disposed in between the substrate layer 304 and substrate layer 308, an antenna feed (e.g., antenna feed 312) disposed on an another additional substrate layer (e.g., substrate layer 314), adjacent to substrate layer 308 and the slotted resonant patch antenna 306, dipoles (e.g. non-resonant dipoles 316) disposed on substrate layers 304, 308, 310, and 314, in an interleaved configuration, and an impedance transformer (e.g., coaxial impedance transformer 318) disposed between additional substrate layers 320. In one aspect, the antenna device 300 includes six additional substrate layers of 320 to provide additional signal routing for antenna device 300, but aspect are not so limited and the antenna device 300 may include a different number of additional substrate layers of 320. In some aspects, the additional substrate layers 320 of the antenna device 300 provide stack-up symmetry to mitigate warpage of the antenna device 300. The antenna device 300 may be implemented on a surface such as a printed circuit board (PCB).

In some aspects, the antenna device 300 is a subarray element as part of a subarray of an antenna array (e.g., phased antenna array). In certain aspects, the antenna device 300, as a subarray element, includes one resonant patch antenna (e.g., resonant patch antenna 302), one slotted resonant patch antenna (e.g., slotted resonant patch antenna 306), one antenna feed (e.g., antenna feed 312), and an impedance transformer (e.g., coaxial impedance transformer 318). In some aspects, the antenna device 300 is a subarray element as part of a 2×2 subarray, including four subarray elements, wherein each subarray element is coupled to one out of a plurality of ports of an integrated circuit, for example a radio frequency integrated circuit (RFIC) (e.g., one out of four ports of RFIC 322), through the coaxial impedance transformer 318. However, aspects are not so limited and the antenna device 300 may also be a subarray element of a larger or smaller subarray, and may couple to an RFIC through other methods. Further, each subarray can be arranged, in some aspects, to construct a phased array antenna (e.g., phased array antenna for large-scale mmWave communications)

In some aspects, a package z-height of the antenna device 300 (e.g., package z-height 324, including an RFIC 322 or not including RFIC 322) can impact scanning nulls of an antenna array. Scanning nulls can emanate from excitation of the zero cutoff-off frequency $TM_0$ surface mode and move toward broadside of the antenna device 300 as a dielectric thickness of the antenna device 300 is increased. In certain aspects, by thinning the z-height 324 of the antenna device 300, an induced scanning null can be pushed below −70 degrees and above positive +70 degrees, extending the effective scanning range of the phased array to +/−60 degrees in azimuth and elevation.

In some aspects, the antenna device 300 includes stacked resonators, for example the resonant patch antenna 302 and the slotted resonant patch antenna 306 disposed on substrate layers 304 and 308, in a stacked configuration (e.g., substrate layer 310 being disposed in between substrate layer 304 and substrate layer 308). In some aspects, resonant patch antenna 302 is configured to radiate in a broadside (e.g., normal) direction and couple to the slotted resonant patch antenna 306 via inductive coupling. in certain aspects, the slotted resonant patch antenna 306 is a patch antenna that includes an etched rectangular slot to weaken magnetic coupling between stacked resonators on a top substrate layer (e.g., substrate layer 304) and middle layers (e.g., substrate layer 308), compensating for an increased coupling due to a decreased z-height, thereby achieving improvements in impedance bandwidth (e.g., impedance bandwidth in excess of 10 GHz). Because of this compensation of increased coupling, the antenna device 300, in certain aspects, does not require any parasitic elements for decoupling resonators on a top and middle substrate layer. In some aspects, the slotted resonant patch antenna 306 capacitively couples to the antenna feed 312 and can receive radiofrequency (RF) signals from the antenna feed 312, for transmission by the antenna device 300, or transmit RF signals to the antenna feed 312, through the capacitance coupling, for example, RF signals received by the antenna device 300.

The antenna feed 312, in certain aspects, is disposed on substrate layer 314, adjacent to the slotted resonant patch antenna 306 on substrate layer 308. Further, the antenna feed 312, in some aspects, is coupled to the impedance transformer 318. By coupling to the impedance transformer 318, the antenna feed 312 can receive RF signals from the antenna feed. 312 for transmission by the antenna device 300, or transmit RF signals to the antenna feed 312, for example, RF signals received by the antenna device 300. In some aspects, the impedance transformer includes a plurality of vias, which are disposed within a plurality of substrate layers (e.g., substrate layers 320). Such vias can couple the RFIC 322 (e.g., via RFIC bumps 326) to the antenna feed 312, through a plurality of substrate layers (e.g., substrate layers 320). Particularly, the vias of impedance transformer 318 can include one via that couples RFIC 322 to the antenna feed 312.

In some aspects, further described below, the impedance transformer 318 can realize an insertion loss of less than 0.2 dB and enable scalability of very large arrays with a total efficiency of 85%, including all loss mechanisms (e.g., conductor loss, substrate loss, and surface wave loss). In certain aspects, the antenna device 300 can achieve a power loss of only 0.7 dB at certain high frequencies (e.g., mmWave frequencies) through the use of the impedance transformer 318. Further, in some aspects, increasing an outer diameter of the impedance transformer 318 can result in an increase in a real part of an input impedance of the antenna device 300, and thus a characteristic impedance of the impedance transformer 318. Further, in certain aspects, increasing an outer diameter of the impedance transformer 318 can result in an input impedance match to any desired bump impedance, in particular 50Ω in the case where RFIC ports are matched to 50Ω.

In some aspects, the antenna device 300 further includes a plurality of nonresonant dipoles 316, interleaved on substrate layers 304, 308, 310, and 314. Particularly, in certain aspects, the nonresonant dipoles 316 mitigate warpage of the antenna device 300 by increasing metal density (e.g., from 0 to 30% in the worst case) without altering the phased array functionality of the antenna device 300. Further, the nonresonant dipoles 316 have an electrical length, for example, of less than λ/4 wavelength and are disposed on the substrate layers 304, 308, 310, and 314 orthogonally to the electric field of the antenna device 300. In certain aspects, nonresonant dipoles 316 comprise a metal pattern and are interleaved between stacked layers, etched on critical substrate layers in a proximity to radiating elements (e.g., resonant patch antenna 302 and slotted resonant patch antenna 306). In some aspects, the nonresonant dipoles 316 are suitable as nonresonant patterns due to their low radiation resistance (e.g., less than 10Ω). When cross polarized, the scattering cross-section of the nonresonant dipoles 316 is also minimized, in certain aspects, interleaving the nonresonant dipoles 316 reduces capacitive coupling between closely spaced stacked layers; such capacitive coupling when strong enough establishes a virtual short that would otherwise couple to the radiating element fringing fields.

In some aspects, the RFIC 322 is configured to receive RE signals for the antenna device 300, from the resonant patch antenna 302, through the slotted resonant patch antenna 306, the antenna feed 312, and the impedance transformer 318. Additionally, in some aspects, the RFIC 322 is configured to transmit RF signals, from the antenna device 300, by the resonant patch antenna 302, through the impedance transformer 318, the antenna feed 312, and the slotted resonant patch antenna 306. In some aspects, the RFIC 322 is attached to the antenna device 300 through flip-chip attachment although aspects are not so limited. The RFIC 322 may be part of the antenna device 300 (e.g., within a wireless communication device), or may be separate from the antenna device 300 and operably coupled to the antenna device 300. Further, in certain aspects, the RFIC 322 can be operably coupled to control and baseband circuitry to receive control signals and baseband signals for processing communication signals transmitted from and received by the antenna device 300.

Figure 4:
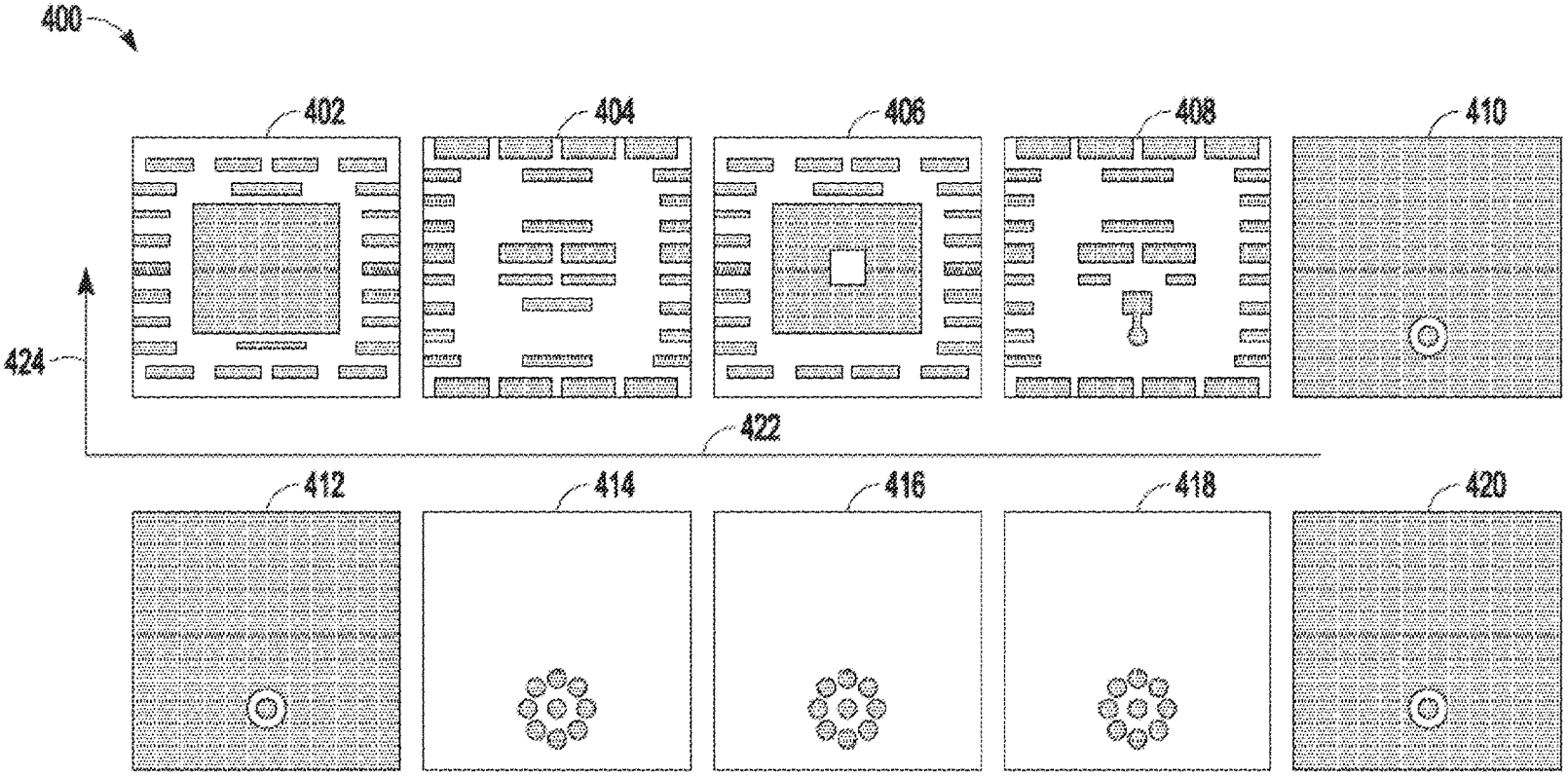
FIG. 4 illustrates a set of layers that make up an exemplary subarray antenna package unit cell stack up of an exemplary antenna device, according to some aspects.

FIG. 4 illustrates a set of layers that make up an exemplary subarray antenna package unit cell, according to some aspects. In some aspects, the antenna device 400 includes substrate layers (e.g., substrate layers 402-420) having resonant elements, nonresonant elements, an antenna feed, and further includes substrate layers having an impedance transformer. FIG. 4 further illustrates an E field polarization of the antenna device 400 and a package symmetry plane of the antenna device 400. In certain aspects, the antenna device 400 includes substrate layer 402 with a resonant patch antenna (e.g., resonant patch antenna 302), substrate layer 404 with nonresonant dipoles (e.g., nonresonant dipoles 316), substrate layer 406 with a slotted resonant patch (e.g., slotted resonant patch 306), substrate layer 408 with nonresonant dipoles (e.g., nonresonant dipoles 316) and an antenna feed (e.g., antenna feed 312), and substrate layers 410 through 420, each including a portion of an impedance transformer (e.g., impedance transformer 318).

Similar to FIG. 3, in some aspects, the antenna device 400 can be a subarray element as part of a subarray of an antenna array (e.g., phased antenna array). In certain aspects, the antenna device 400, as a subarray element, can include one resonant patch antenna on substrate layer 402 (e.g., resonant patch antenna 302), one slotted resonant patch antenna on substrate layer 406 (e.g., slotted resonant patch antenna 306), one antenna feed on substrate layer 408 (e.g., antenna feed 312), and an impedance transformer within substrate layers 410-420 (e.g., coaxial impedance transformer 318). In some aspects, the antenna device 400 is a subarray element as part of a 2×2 subarray, including four subarray elements, wherein each subarray element is coupled to one out of a plurality of ports on an WIC through an impedance transformer (e.g., coaxial impedance transformer 318 in substrate layers 410-420) and each subarray can be arranged to construct a phased array antenna.

In some aspects, the antenna device 400 includes stacked resonators, for example the resonant patch antenna 302 and the slotted resonant patch antenna 306 disposed on substrate layers 402 and 406, respectively. Similar to FIG. 3, in some aspects, resonant patch antenna 302 on substrate layer 402 is configured to radiate in a broadside direction and couples to the slotted resonant patch antenna 306 on substrate layer 406 via magnetic coupling. In some aspects, the slotted resonant patch antenna 306 (e.g., substrate layer 406) capacitively couples to the antenna feed 312 (e.g., substrate layer 408) and can receive RF signals from the antenna feed 312, for transmission by the antenna device 400, or transmit RF signals to the antenna feed 312, through the capacitance coupling, for example, RF signals received by the antenna device 400.

In certain aspects, antenna feed 312 is disposed on substrate layer 408, adjacent to (e.g., below) the slotted resonant patch antenna 306 on substrate layer 406. Further, the antenna feed 312, in some aspects, is coupled to the impedance transformer 318, between substrate layers 408 and 410. In some aspects, the impedance transformer includes a plurality of vias, which are disposed within a plurality of substrate layers (e.g., substrate layers 410-420). Vias shown in substrate layers 410 through 420 can couple the RFIC 322 to the antenna feed 312 (e.g., on substrate layer 408).

In some aspects, the antenna device 400 further includes a plurality of nonresonant dipoles (e.g., nonresonant dipoles 316), interleaved on substrate layers 402, 404, 406, and 408. Similar to FIG. 3, the nonresonant dipoles 316 mitigate warpage of the antenna device 400 by increasing metal density between the substrate layers 402-408. The nonresonant dipoles 316 can have an electrical length of less than λ/4 wavelength and can be disposed orthogonally to the electric field of the antenna device 400 to ensure nonresonance. In certain aspects, interleaving the nonresonant dipoles 316 between layers 402-408 reduces capacitive coupling between the closely spaced stacked layers 402-408.

In some aspects, an integrated circuit (e.g., RFIC 322) is attached to the antenna device 400, for example, on the bottom side of substrate layer 420, and is configured to receive RF signals, received by the antenna device 400, from the resonant patch antenna 302 on substrate layer 402, through the slotted resonant patch antenna 306 on substrate layer 406, the antenna feed 312 on substrate layer 408, and the impedance transformer 318 within substrate layers 410, 412, 414, 416, 418, and 420. Additionally, the RFIC 322 may transmit RF signals, from the antenna device 400, by the resonant patch antenna 302 on substrate layer 402, through the impedance transformer 318, the antenna feed 312, and the slotted resonant patch antenna 306. Similar to FIG. 3, the RFIC 322 may be attached to the antenna device 400 through flip-chip attachment although aspects are not so limited.

Figure 5:
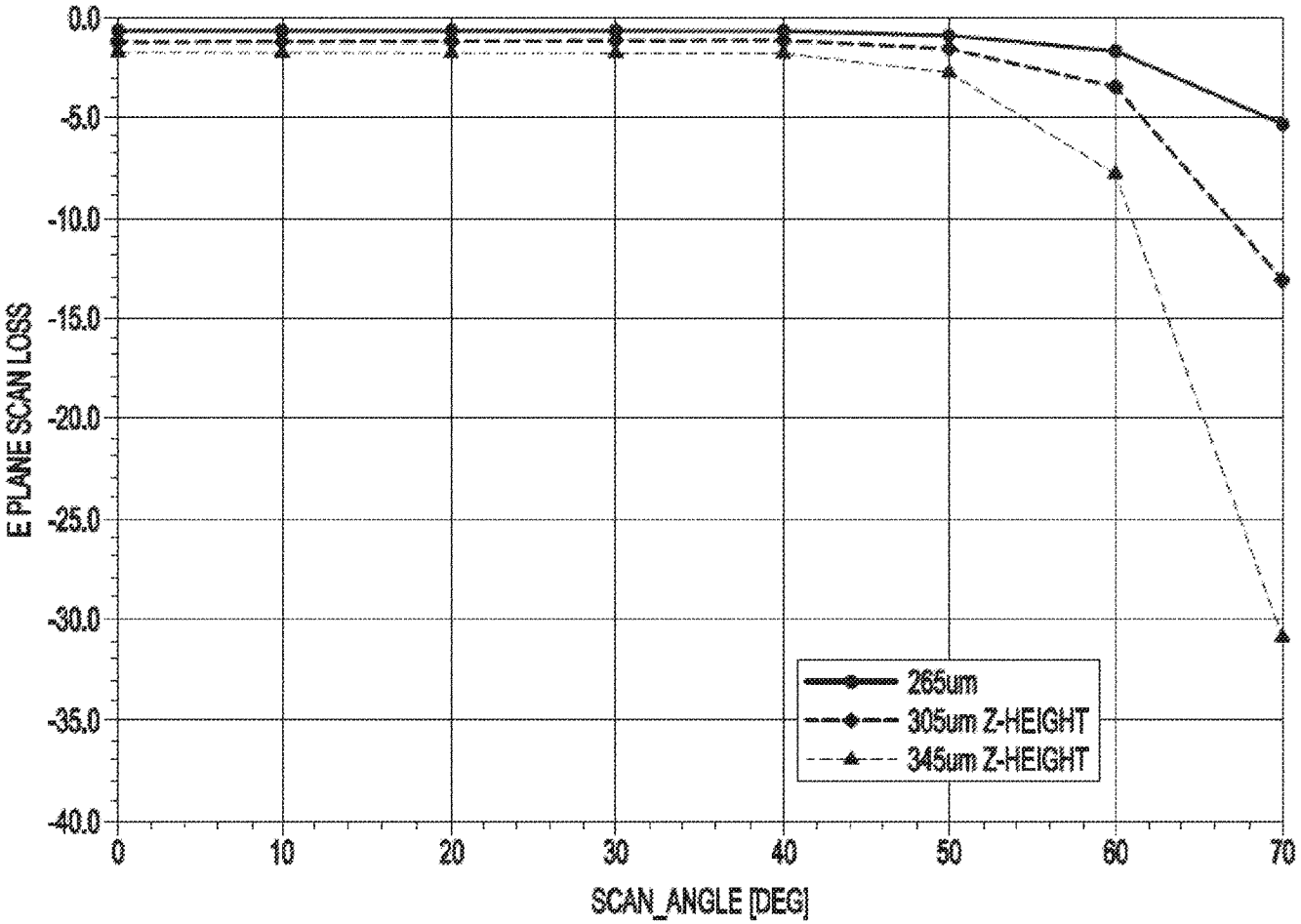
FIG. 5 illustrates scan blindness of the antenna device, according to some aspects.

FIG. 5 illustrates scan blindness of the antenna device, according to some aspects. As shown in FIG. 5, at 76 GHz for example, the E plane scan loss as a function of scan angle is improved for an antenna device (e.g., antenna device 300 or 400), having aspects as described above. In certain aspects, the antenna device 300 or 400 as described, having a z-height of 265 μm, can push a scanning null below −70 degrees and above positive +70 degrees, extending the effective scanning range of the phased array to +/−60 degrees in azimuth and elevation.

Figure 6:
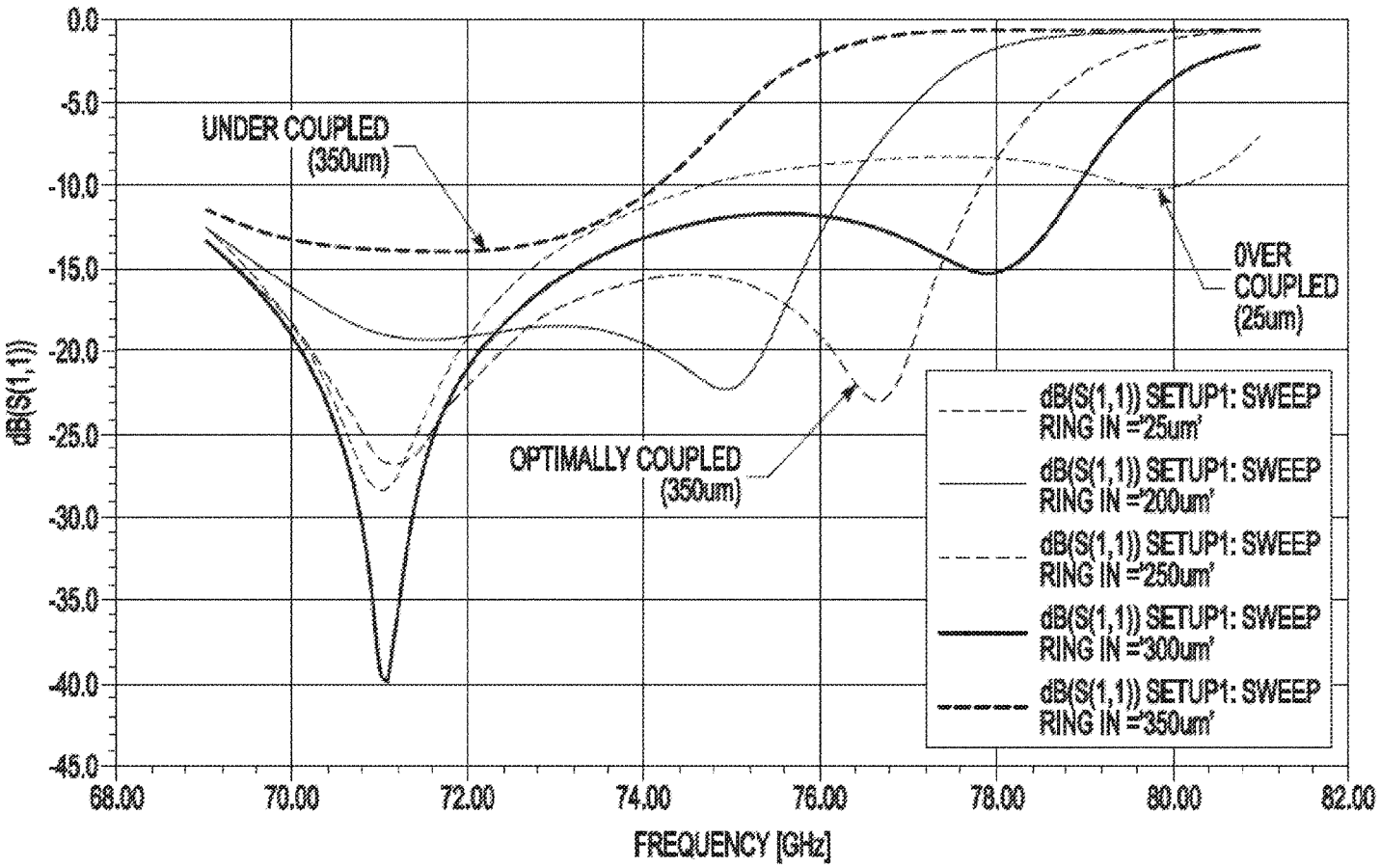
FIG. 6 illustrates S11 values of an antenna device as a function of frequency, according to some aspects.

FIG. 6 illustrates S11 values of an antenna device (e.g. antenna device 300 or 400) as a function of frequency, according to some aspects. In particular, FIG. 6 shows an effect of a slot width of the slotted resonant patch antenna 306 on bandwidth of the antenna device 300 or 400. As shown in FIG. 6, at a slot width of 250 μm, the antenna device (e.g., antenna device 300 or 400), having aspects as described above, is optimally coupled. In contrast, as seen in FIG. 6, a slot width of 350 μm results in the antenna device 300 or 400 being under-coupled, and in contrast, with a slot width of 25 μm, the antenna device 300 or 400 is over-coupled. In both scenarios, being over-coupled and under-coupled, the performance of the antenna device 300 or 400 suffers, as package z-height is decreased, without an optimal slot width in the slotted resonant patch antenna 306, or without the slotted resonant patch antenna 306 altogether.

Figure 7:
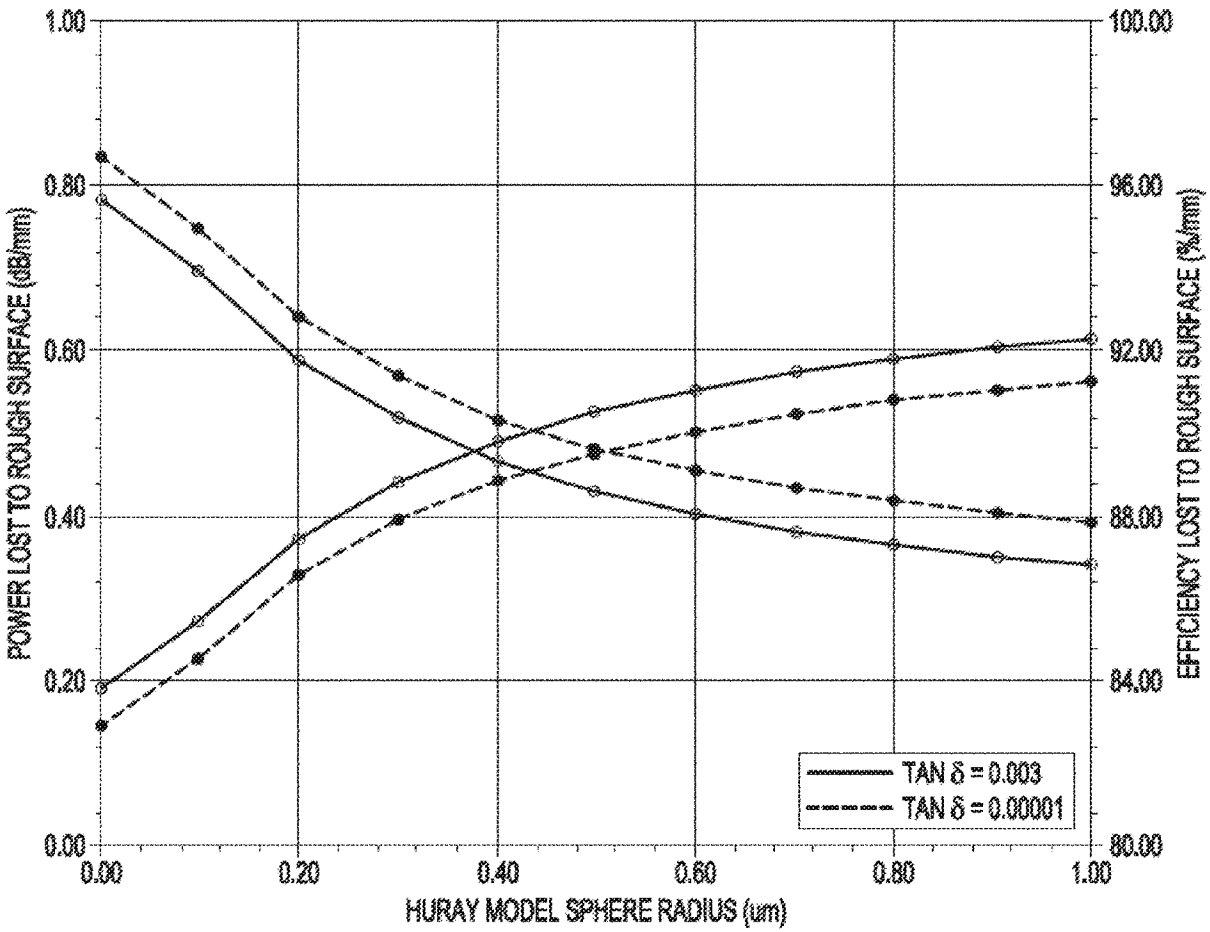
FIG. 7 illustrates strip line losses according to surface roughness of metal layers of an antenna device, according to some aspects.

FIG. 7 illustrates strip line losses according to surface roughness of metal layers of an antenna device (e.g, antenna device 300 or 400), according to some aspects. FIG. 7 illustrates how signal routing in strip line (e.g., 50Ω) or air-filled waveguide type transmission lines results in efficiency losses, for example, as shown at 73 GHz. A benefit of not using a strip line is immunity to the conductor surface roughness and associated conductor losses (e.g., amounting for roughly 0.5 dB/mm). Likewise, a benefit of not using an air-filled waveguide is a reduction in the complexity for transitioning from an integrated circuit (e.g., RFIC) bump to a port on the antenna device 300 or 400.

Figure 8:
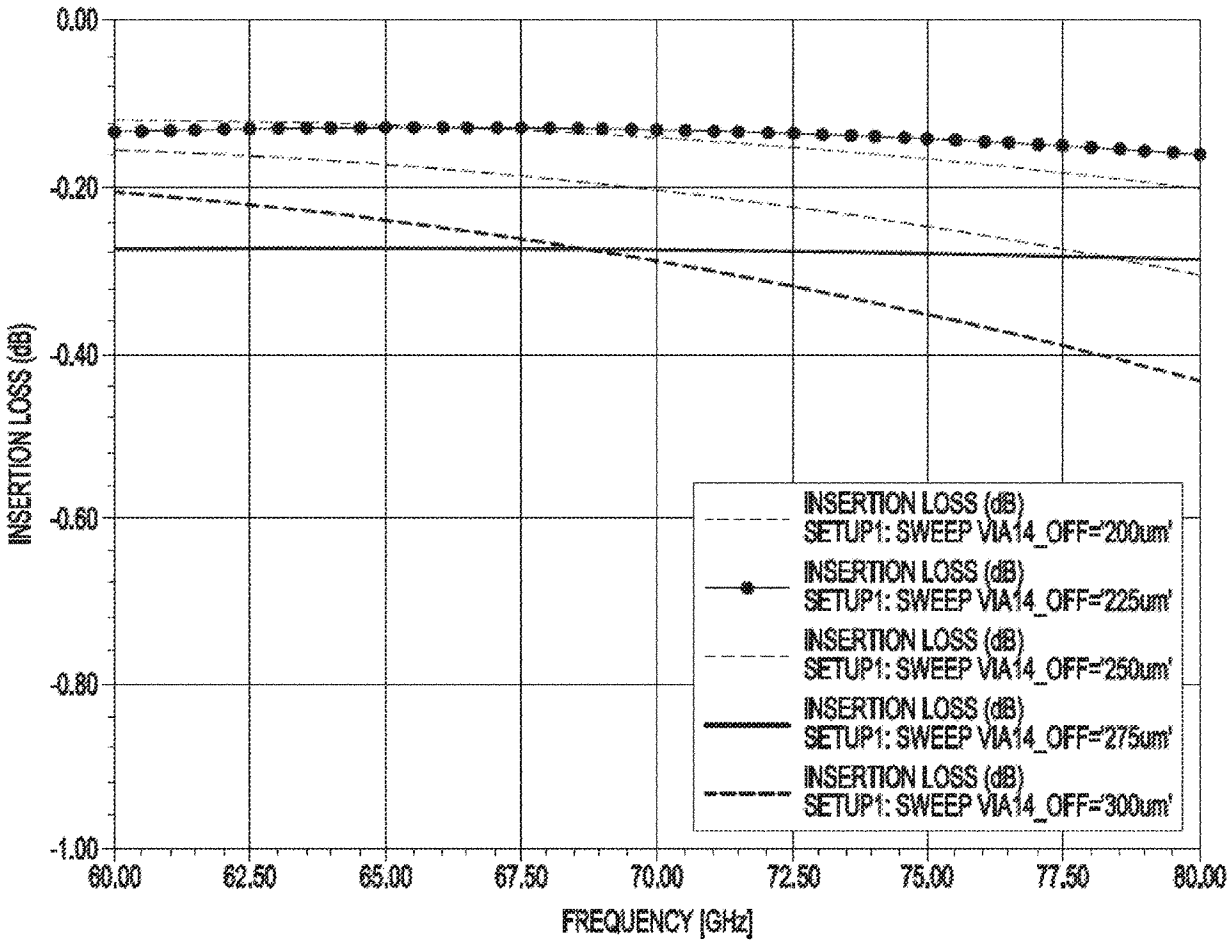
FIG. 8 illustrates insertion losses of an impedance transformer, according to some aspects.

FIG. 8 illustrates insertion losses of an impedance transformer, according to some aspects. FIG. 8 illustrates how the use of an impedance transformer (e.g., coaxial impedance transformer 318), as described, results in improved insertion loss of the antenna device 300 or 400. In some aspects, the coaxial impedance transformer 318 can realize less than 0.2 dB insertion loss and can enable scalability of very large arrays with 85% total efficiency, including all loss mechanisms (e.g., conductor loss, substrate loss, and surface wave loss).

Figure 9:
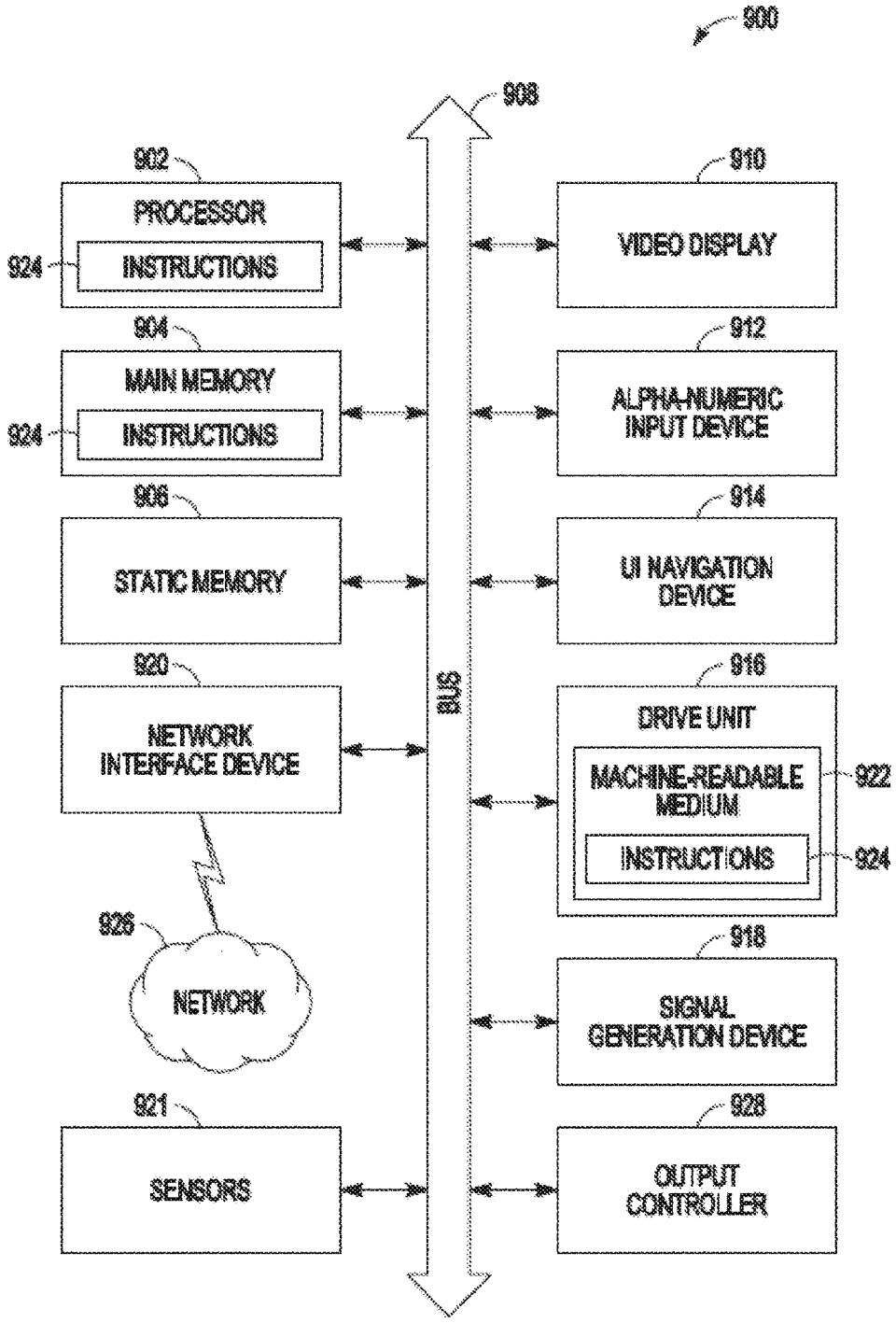
FIG. 9 illustrates block diagram of a communication device in accordance with some aspects.

FIG. 9 illustrates block diagram of a communication device in accordance with some aspects. In alternative aspects, the communication device 900 may operate as a standalone device or may be connected (e.g., networked) to other communication devices. In a networked deployment, the communication device 900 may operate in the capacity of a server communication device, a client communication device, or both in server-client network environments.

In an example, the communication device 900 may act as a peer communication device in peer-to-peer (P2P) (or other distributed) network environment. The communication device 900 may be UE, an eNB, a personal computer (PC), a tablet PC, a STB, a PDA, a mobile telephone, a smart phone, a web appliance, a network router, switch or bridge, or any communication device capable of executing instructions (sequential or otherwise) that specify actions to be taken by that communication device. Further, while only a single communication device is illustrated, the term "communication device" shall also be taken to include any collection of communication devices that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a communication device readable medium. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired using circuitry), or configured (e.g., programmed) to operate in a specified manner or to perform part or all of any operation described herein. Considering examples in which modules are configured, each of the modules need not be instantiated at any one moment in time. For example, where the modules include a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

The communication device 900 (e.g., computer system) may include a hardware processor 902 (e.g., a central processing unit (CPU), a graphics processing unit (GPU), a hardware processor core, or any combination thereof), a main memory 904 and a static memory 906, some or all of which may communicate with each other via an interlink (e.g., bus) 908.

The communication device 900 may further include a display unit 910, an alphanumeric input device 912 (e.g., a keyboard), and a user interface (UI) navigation device 914

(e.g., a mouse). In an example, the display unit 910, input device 912 and UI navigation device 914 may be a touch screen display.

The communication device 900 may additionally include a storage device (e.g., drive unit) 916, a signal generation device 918 (e.g., a speaker), a network interface device 920, and one or more sensors 921, such as a global positioning system (GPS) sensor, compass, accelerometer, or other sensor. The communication device 900 may include an output controller 928, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 916 may include a communication device readable medium 922 on which is stored one or more sets of data structures or instructions 924 (e.g., software) embodying or utilized by any one or more of the techniques or functions described herein. The instructions 924 may also reside, completely or at least partially, within the main memory 904, within static memory 906, or within the hardware processor 902 during execution thereof by the communication device 900. In an example, one or any combination of the hardware processor 902, the main memory 904, the static memory 906, or the storage device 916 may constitute the communication device readable medium 922.

While the communication device readable medium 922 is illustrated as a single medium, the term "communication device readable medium" may include a single medium or multiple media (e.g., a centralized or distributed database, and/or associated caches and servers) configured to store the one or more instructions 924.

The term "communication device readable medium" may include any medium that is capable of storing, and/or carrying instructions for execution by the communication device 900 and that cause the communication device 900 to perform any one or more of the techniques of the present disclosure, or that is capable of storing, encoding or carrying data structures used by or associated with such instructions. Non-limiting examples of the communication device readable medium 922 may include solid-state memories, and optical and magnetic media. Specific examples of communication device readable media 922 may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; Random Access Memory (RAM); and CD-ROM and DVD-ROM disks. In some examples, communication device readable media may include non-transitory communication device readable media. In some examples, communication device readable media may include communication device readable media that is not a transitory propagating signal.

The instructions 924 may further be transmitted or received over a communications network 926 via the network interface device 920 that is compatible with one or more transfer protocols (e.g., frame relay, internee protocol (IP), transmission control protocol (TCP), user datagram protocol (UDP), hypertext transfer protocol (HTTP), etc.). Example communication networks 926 may include a local area network (LAN), a wide area network (WAN), a packet data network (e.g., the Internet), mobile telephone networks (e.g., cellular networks), Plain Old Telephone (POTS) networks, and/or wireless data networks (e.g., IEEE 802.11 family of standards known as WiFi®, IEEE 802.16 family of standards known as WiMax®), IEEE 802.15.4 family of standards, a LTE family of standards, a UMTS family of standards, peer-to-peer (P2P) networks, among others.

In an example, the network interface device 920 may include one or more physical jacks (e.g., Ethernet, coaxial, or phone jacks) or one or more antennas to connect to the communications network 926. In an example, the network interface device 920 may include a plurality of antennas to wirelessly communicate using at least one of single-input multiple-output (SIMO), MIMO, or multiple-input single-output (MISO) techniques. In some examples, the network interface device 920 may wirelessly communicate using Multiple User MIMO techniques.

Figure 10:
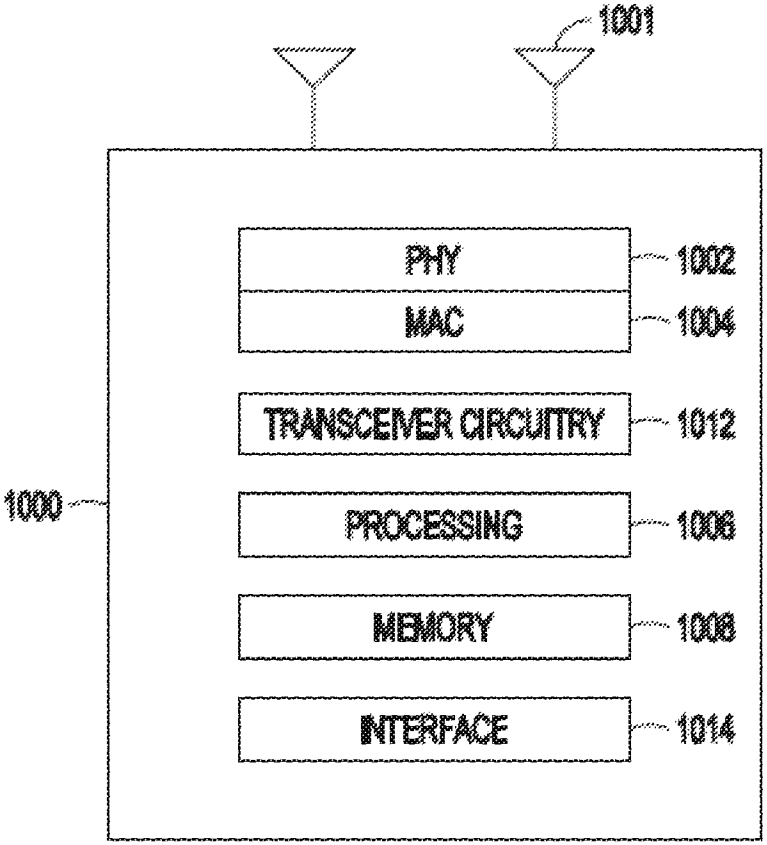
FIG. 10 is a block diagram of a communication device in accordance with some aspects.

FIG. 10 is a block diagram of a communication device in accordance with some aspects. The physical layer module 1002 may perform various encoding and decoding functions that may include formation of baseband signals for transmission and decoding of received signals. The communication device 1000 may also include medium access control layer (MAC) module 1004 for controlling access to the wireless medium. The communication device 1000 may also include processing module 1006, such as one or more single-core or multi-core processors, and memory 1008 arranged to perform the operations described herein.

The communication device 1000 may include a transceiver module 1012 to enable communication with other external devices wirelessly and interfaces 1014 to enable wired communication with other external devices. As another example, the transceiver circuitry 1012 may perform various transmission and reception functions such as conversion of signals between a baseband range and a Radio Frequency (RF) range. In some embodiments, the physical layer module 1002, the MAC module, the processing module 1006, the transceiver module 1012, and/or interfaces 1014 may be implemented using circuitry, such as integrated circuits or integrated chip.

In some aspects, the antennas 1001 may include one or more directional or omnidirectional antennas, including, for example, dipole antennas, monopole antennas, patch antennas, loop antennas, micro-strip antennas or other types of antennas suitable for transmission of RF signals. In some MIMO aspects, the antennas 1001 may be effectively separated to take advantage of spatial diversity and the different channel characteristics that may result.

In some aspects, the physical layer module 1002, the MAC module 1004, and the processing module 1006 may handle various radio control functions that enable communication with one or more radio networks compatible with one or more radio technologies. The radio control functions may include signal modulation, encoding, decoding, radio frequency shifting, etc. For example, similar to the device shown in FIG. 2, in some aspects, communication may be enabled with one or more of a WMAN, a WLAN, and a WPAN. In some aspects, the communication device 1000 can be configured to operate in accordance with 3GPP standards or other protocols or standards, including WiMax, WiFi, WiGig, GSM, EDGE, GERAN, UMTS, UTRAN, or other 2G, 3G, 4G, 5G, etc. technologies either already developed or to be developed.

Although the communication device 1000 is illustrated as having several separate functional elements, one or more of the functional elements may be combined and may be implemented by combinations of software-configured elements, such as processing elements including DSPs, and/or other hardware elements. For example, some elements may include one or more microprocessors, DSPs, FPGAs, ASICs, RFICs and combinations of various hardware and logic circuitry for performing at least the functions described herein. In some aspects, the functional elements may refer to one or more processes operating on one or more processing elements. Aspects may be implemented in one or a combination of hardware, firmware and software. Aspects may also be implemented as instructions stored on a computer-readable storage device, which may be read and executed by at least one processor to perform the operations described herein.

Figure 11:
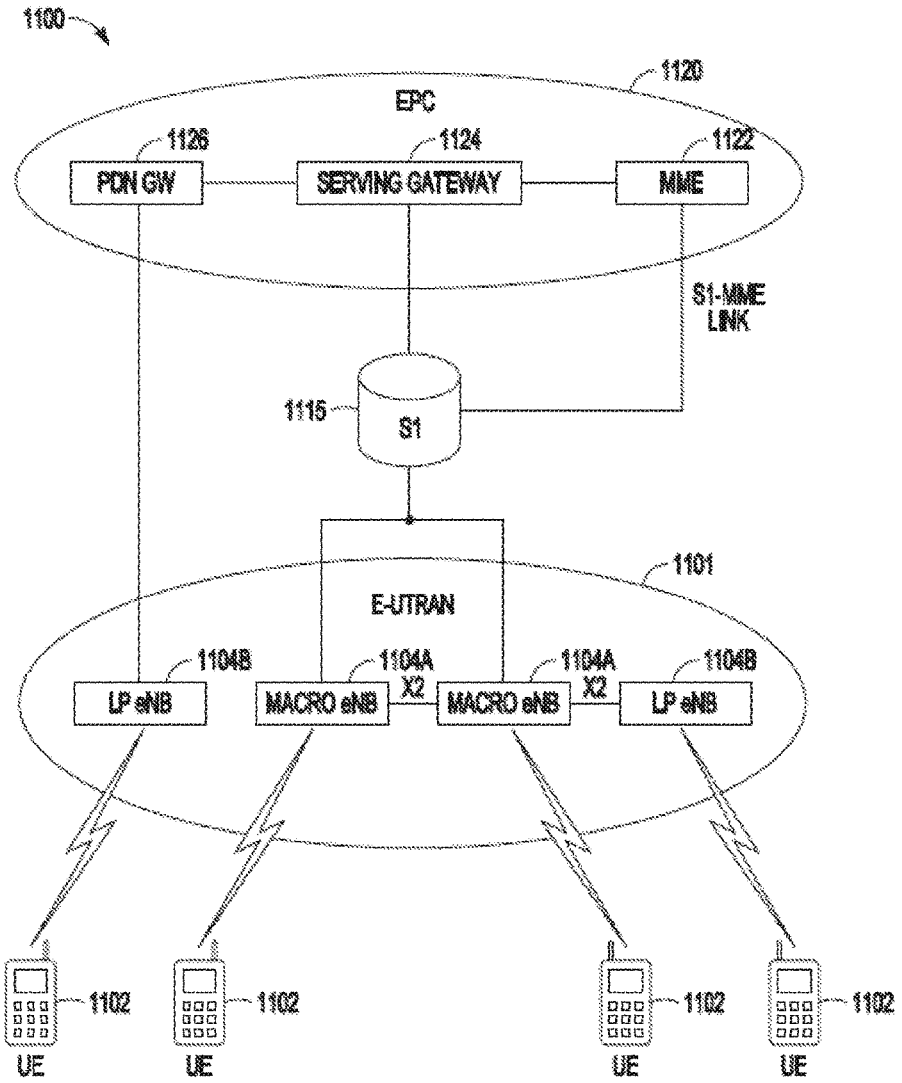
FIG. 11 shows a portion of an end-to-end network architecture of a network with various components of the network in accordance with some aspects.

FIG. 11 shows a portion of an end-to-end network architecture of a network (e.g. LTE network) with various components of the network in accordance with some aspects. The network 1100 comprises a radio access network (RAN) (e.g., as depicted, the E-UTRAN 1101 or evolved universal terrestrial radio access network) 1100 and the core network 1120 (e.g., shown as an evolved packet core (EPC)) coupled together through an S1 interface 1115. For convenience and brevity sake, only a portion of the core network 1120, as well as the RAN 1100, is shown.

The core network 1120 includes mobility management entity (MME) 1122, serving gateway (serving GW) 1124, and packet data network gateway (PDN GW) 1126. The RAN includes enhanced node B's (eNBs) 1104 (which may operate as base stations) for communicating with user equipment (UE) 1102. The eNBs 1104 may include macro eNBs and low power (LP) eNBs.

The MME is similar in function to the control plane of legacy Serving GPRS Support Nodes (SGSN). The MME manages mobility aspects in access such as gateway selection and tracking area list management. The serving GW 1124 terminates the interface toward the RAN 1100, and routes data packets between the RAN 1100 and the core network 1120. In addition, it may be a local mobility anchor point for inter-eNB handovers and also may provide an anchor for inter-3GPP mobility. Other responsibilities may include lawful intercept, charging, and some policy enforcement. The serving GW 1124 and the MME 1122 may be implemented in one physical node or separate physical nodes. The PDN GW 1126 terminates an SGi interface toward the packet data network (PDN). The PDN GW 1126 routes data packets between the EPC 1120 and the external PDN, and may be a key node for policy enforcement and charging data collection. It may also provide an anchor point for mobility with non-LTE accesses. The external PDN can be any kind of IP network, as well as an IP Multimedia Subsystem (IMS) domain. The PDN GW 1126 and the serving GW 1124 may be implemented in one physical node or separated physical nodes.

The eNBs 1104 (macro and micro) terminate the air interface protocol and may be the first point of contact for a UE 1102. In some aspects, an eNB 1104 may fulfill various logical functions for the RAN 1100 including but not limited to RNC (radio network controller functions) such as radio bearer management, uplink and downlink dynamic radio resource management and data packet scheduling, and mobility management. In accordance with aspects, UEs 1102 may be configured to communicate OFDM communication signals with an eNB 1104 over a multicarrier communication channel in accordance with an OFDMA communication technique. The OFDM signals may comprise a plurality of orthogonal subcarriers.

The S1 interface 1115 is the interface that separates the RAN 1100 and the EPC 1120. It is split into two parts: the S1-U, which carries traffic data between the eNBs 1104 and the serving GW 1124, and the S1-MME, which is a signaling interface between the eNBs 1104 and the MME 1122. The X2 interface is the interface between eNbs 1104. The X2 interface comprises two parts, the X2-C and X2-U. The X2-C is the control plane interface between the eNbs 1104, while the X2-U is the user plane interface between the eNbs 1104.

With cellular networks, LP cells are typically used to extend coverage to indoor areas where outdoor signals do not reach well, or to add network capacity in areas with very dense phone usage, such as train stations. As used herein, the term low power (LP) eNB refers to any suitable relatively low power eNB for implementing a narrower cell (narrower than a macro cell) such as a femtocell, a picocell, or a micro cell. Femtocell eNBs are typically provided by a mobile network operator to its residential or enterprise customers. A femtocell is typically the size of a residential gateway or smaller, and generally connects to the user's broadband line. Once plugged in, the femtocell connects to the mobile operator's mobile network and provides extra coverage in a range of typically 30 to 50 meters for residential femtocells. Thus, a LP eNB might be a femtocell eNB since it is coupled through the PDN GW 1126. Similarly, a picocell is a wireless communication system typically covering a small area, such as in-building (offices, shopping malls, train stations, etc.), or more recently in-aircraft. A picocell eNB can generally connect through the X2 link to another eNB such as a macro eNB through its base station controller (BSC) functionality. Thus, LP eNB may be implemented with a picocell eNB since it is coupled to a macro eNB via an X2 interface, Picocell eNBs or other LP eNBs may incorporate some or all functionality of a macro eNB. In some cases, this may be referred to as an access point base station or enterprise femtocell.

In some aspects, a downlink resource grid may be used for downlink transmissions from an eNB to a UE. The grid may be a time-frequency grid, called a resource grid, which is the physical resource in the downlink in each slot. Such a time-frequency plane representation is a common practice for OFDM systems, which makes it intuitive for radio resource allocation. Each column and each row of the resource grid correspond to one OFDM symbol and one OFDM subcarrier, respectively. The duration of the resource grid in the time domain corresponds to one slot in a radio frame. The smallest time-frequency unit in a resource grid is denoted as a resource element. Each resource grid comprises a number of resource blocks, which describe the mapping of certain physical channels to resource elements. Each resource block comprises a collection of resource elements and in the frequency domain, this represents the smallest quanta of resources that currently can be allocated, There are several different physical downlink channels that are conveyed using such resource blocks. With particular relevance to this disclosure, two of these physical downlink channels are the physical downlink shared channel and the physical down link control channel.

The physical downlink shared channel (PDSCH) carries user data and higher-layer signaling to a UE 1102 of FIG. 11. The physical downlink control channel (PDCCH) carries information about the transport format and resource allocations related to the PDSCH channel, among other things. It also informs the HE about the transport format, resource allocation, and H-ARQ information related to the uplink shared channel. Typically, downlink scheduling (assigning control and shared channel resource blocks to UEs within a cell) is performed at the eNB based on channel quality information fed back from the UEs to the eNB, and then the downlink resource assignment information is sent to a UE on the control channel (PDCCH) used for (assigned to) the UE.

The PDCCH uses CCEs (control channel elements) to convey the control information. Before being mapped to resource elements, the PDCCH complex-valued symbols are first organized into quadruplets, which are then permuted using a sub-block inter-leaver for rate matching. Each PDCCH is transmitted using one or more of these control channel elements (CCEs), where each CCE corresponds to nine sets of four physical resource elements known as resource element groups (REGs). Four QPSK symbols are mapped to each REG. The PDCCH can be transmitted using one or more CCEs, depending on the size of DCI and the channel condition. There may be four or more different PDCCH formats defined in LTE with different numbers of CCEs (e.g., aggregation level, L,=1, 2, 4, or 8).

EXAMPLES AND ADDITIONAL NOTES

A first example provides a multilayer package for high frequency communications, comprising: a plurality of patch antennas disposed on a first substrate; a plurality of slotted patch antennas disposed on a third substrate, wherein the first substrate and the third substrate are disposed on opposing sides of a second substrate, and wherein each slotted patch antenna is configured to magnetically couple to one of the patch antennas; a plurality of antenna feeds disposed on a fourth substrate, wherein the fourth substrate is disposed adjacent to the third substrate; and wherein each antenna feed is configured to capacitively couple to one of the slotted patch antennas; a plurality of dipoles disposed on the first substrate, the second substrate, the third substrate, and the fourth substrate; and an impedance transformer, disposed within one or more additional substrates, wherein the impedance transformer is configured to couple an integrated circuit to the one of the antenna feeds through the one or more additional substrates.

A second example provides a multilayer package according to the first example, wherein the plurality of dipoles are interleaved on the first substrate, the second substrate, the third substrate, and the fourth substrate.

A third example provides a multilayer package according to the second example, wherein the plurality of dipoles are non-resonant dipoles.

A fourth example provides the multilayer package according to the third example, wherein the plurality of dipoles each have an electrical length of less than one-quarter wavelength.

A fifth example provides the multilayer package according to the fourth example, wherein the plurality of dipoles are disposed orthogonally to an electric field of the multilayer package.

A sixth example provides the multilayer package according any one or more of the second example through the fifth example, wherein the plurality of dipoles increase a metal density of the multilayer package to mitigate a substrate warpage of the multilayer package.

A seventh example provides the multilayer package according to any one or more of the first example through the sixth example, wherein the impedance transformer is a coaxial impedance transformer including a plurality of vias, and wherein at least one of the plurality of vias is configured to couple the integrated circuit to the one of the plurality of antenna feeds through the one or more additional substrates.

An eighth example provides the multilayer package according any one or more of the first example through the seventh example, wherein the impedance transformer is configured to match an impedance of a signal path, between the integrated circuit and the one of the plurality of antenna feeds, to one or more resonant frequencies.

A ninth example provides the multilayer package according any one or more of the first example through the eighth example, wherein the integrated circuit is disposed on an outer side of an additional substrate opposite the plurality of patch antennas.

A tenth example provides the multilayer package according any one or more of the seventh example through the ninth example, wherein the multilayer package is a subarray of a phased antenna array, the subarray including a plurality of subarray elements, wherein each subarray element includes one of the plurality of patch antennas, one of the plurality of slotted patch antennas, one of the plurality of antenna feeds, and a plurality of vias of the impedance transformer, one of the plurality of vias being configured to couple the integrated circuit to the one of the plurality of antenna feeds, through the one or more additional substrates.

An eleventh example provides the multilayer package according to the tenth example, wherein each of the plurality of subarray elements is configured to feed to one of a plurality of ports of the integrated circuit.

A twelfth example provides the multilayer package according any one or more of the tenth example through the eleventh example, wherein the subarray is configured to extend an effective scanning range of the phased antenna array in both azimuth and elevation.

A thirteenth example provides a wireless communication device for high frequency communications, the wireless communication device comprising: an integrated circuit; and a multilayer package, including: a plurality of patch antennas disposed on a first substrate; a plurality of slotted patch antennas disposed on a third substrate, wherein the first substrate and the third substrate are disposed on opposing sides of a second substrate, and wherein each slotted patch antenna is configured to magnetically couple to one of the patch antennas of the plurality of patch antennas; a plurality of antenna feeds disposed on a fourth substrate, wherein the fourth substrate is disposed adjacent to the third substrate, and wherein each antenna feed is configured to capacitively couple to one of the slotted patch antennas; a plurality of dipoles disposed on the first substrate, the second substrate; the third substrate, and the fourth substrate; and an impedance transformer, disposed within one or more additional substrates, wherein the impedance transformer is configured to couple the integrated circuit to the one of the plurality of antenna feeds through the one or more additional substrates.

A fourteenth example provides the wireless communication device according to the thirteenth example, wherein the plurality dipoles are non-resonant dipoles and are interleaved on the first substrate, the second substrate, the third substrate, and the fourth substrate and are configured to be non-resonant.

A fifteenth example provides the wireless communication device according to the fourteenth example, wherein the plurality of dipoles each have an electrical length of less than one-quarter wavelength and are disposed orthogonal to an electric field of the multilayer package.

A sixteenth example provides the wireless communication device according any one or more of the thirteenth example through the fifteenth example, wherein the impedance transformer is a coaxial impedance transformer including a plurality of vias, and wherein at least one of the plurality of vias is configured to couple the integrated circuit to one of the plurality of antenna feeds, through the one or more additional substrates, and wherein the impedance transformer is configured to match an impedance of a signal path, between the integrated circuit and the one of the plurality of antenna feeds, to one or more resonant frequencies.

A seventeenth example provides the wireless communication device according to the sixteenth example, wherein the multilayer package is a subarray of a phased antenna array, the subarray including a plurality of subarray elements, wherein each subarray element includes one of the plurality of patch antennas, one of the plurality of slotted patch antennas, one of the plurality of antenna feeds, and a plurality of vias of the impedance transformer, one of the plurality of vias being configured to couple the integrated circuit to the one of the plurality of antenna feeds, through the one or more additional substrates.

An eighteenth example provides the wireless communication device according any one or more of the thirteenth example through the seventeenth example, wherein the integrated circuit is configured to: process radio frequency (RF) signals received by one or more patch antennas of the plurality of patch antennas; and process communication signals for transmission through one or more patch antennas of the plurality of patch antennas.

A nineteenth example provides the wireless communication device according any one or more of the thirteenth example through the eighteenth example, wherein the integrated circuit is configured to: receive RF signals from one of the plurality of patch antennas through one of the plurality of slotted patch antennas, one of the plurality of antenna feeds, and the impedance transformer; and transmit RF signals to one of the plurality of patch antennas through the impedance transformer, one of the plurality of antenna feeds, and one of the plurality of slotted patch antennas.

A twentieth example provides the wireless communication device according any one or more of the thirteenth example through the nineteenth example, wherein the plurality of patch antennas, the plurality of slotted patch antennas, the plurality of antenna feeds, the impedance transformer, and the integrated circuit are configured to operate in a millimeter wave (mmWave) frequency band.

A twenty-first example provides the wireless communication device according any one or more of the thirteenth example through the twentieth example, further comprising baseband processing circuitry to provide baseband signals to the integrated circuit.

The above detailed description includes references to the accompanying drawings, which form a part of the detailed description. The drawings show, by way of illustration, specific aspects of the disclosure. These aspects are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other aspects can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope should be determined with reference to the appended claims, along with the full scope of equivalents to which such claims are entitled.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A multilayer package for high frequency communications, comprising:

a plurality of patch antennas disposed on a first substrate;

a second substrate disposed on the first substrate;

a third substrate disposed on the second substrate;

a plurality of slotted patch antennas disposed on the third substrate, and wherein at least one slotted patch antenna is magnetically coupled to one of the plurality of patch antennas;

a fourth substrate is disposed adjacent to the third substrate, a plurality of antenna feeds disposed on the fourth substrate, wherein at least one antenna feed is capacitively coupled to one of the plurality of slotted patch antennas;

an impedance transformer, disposed within one or more additional substrates adjacent to the fourth substrate, the impedance transformer coupled to an integrated circuit and the one of the plurality of antenna feeds through the one or more additional substrates.

2. The multilayer package of claim 1, further comprising a plurality of dipoles disposed on the first substrate, the second substrate, the third substrate, and the fourth substrate.

3. The multilayer package of claim 2, wherein the plurality of dipoles are interleaved on the first substrate, the second substrate, the third substrate, and the fourth substrate.

4. The multilayer package of claim 3, wherein the plurality of dipoles comprises non-resonant dipoles, each having an electrical length of less than one-quarter wavelength.

5. The multilayer package of claim 4, wherein the plurality of dipoles are disposed orthogonally to an electric field of the multilayer package.

6. The multilayer package of claim 2, wherein the plurality of dipoles increase a metal density of the multilayer package to reduce a substrate warpage of the multilayer package.

7. The multilayer package of claim 1, wherein the impedance transformer is a coaxial impedance transformer including a plurality of vias, and wherein at least one of the plurality of vias coupled the integrated circuit to the one of the plurality of antenna feeds through the one or more additional substrates.

8. The multilayer package of claim 1, wherein the impedance transformer matches an impedance of a signal path, between the integrated circuit and the one of the plurality of antenna feeds, to one or more resonant frequencies.

9. The multilayer package of claim 1, wherein the integrated circuit is disposed on an outer side of at least one additional substrate opposite the plurality of patch antennas.

10. The multilayer package of claim 7, wherein the multilayer package is a subarray of a phased antenna array, the subarray including a plurality of subarray elements, wherein each subarray element includes one of the plurality of patch antennas, one of the plurality of slotted patch antennas, one of the plurality of antenna feeds, and a plurality of vias of the impedance transformer, one of the plurality of vias being configured to couple the integrated circuit to the one of the plurality of antenna feeds, through the one or more additional substrates.

11. The multilayer package of claim 10, wherein each of the plurality of subarray elements is configured to feed to one of a plurality of ports of the integrated circuit.

12. The multilayer package of claim 10, wherein the subarray is configured to extend an effective scanning range of the phased antenna array in both azimuth and elevation.

13. A wireless communication device for high frequency communications, the wireless communication device comprising:

an integrated circuit; and a multilayer package, including:

a plurality of patch antennas disposed on a first substrate;

a second substrate disposed on the first substrate;

a third substrate disposed on the second substrate;

a plurality of slotted patch antennas disposed on the third substrate, and wherein at least one slotted patch antenna is magnetically coupled to one of the plurality of patch antennas;

a fourth substrate is disposed adjacent to the third substrate, a plurality of antenna feeds disposed on the fourth substrate, wherein at least one antenna feed is capacitively coupled to one of the plurality of slotted patch antennas;

an impedance transformer, disposed within one or more additional substrates adjacent to the fourth substrate;

the impedance transformer coupled to the integrated circuit and the one of the plurality of antenna feeds through the one or more additional substrates.

14. The wireless communication device of claim 13, further comprising a plurality of dipoles disposed on the first substrate, the second substrate; the third substrate; and the fourth substrate, and wherein the plurality dipoles are non-resonant dipoles and are interleaved on the first substrate, the second substrate, the third substrate, and the fourth substrate and are configured to be non-resonant.

15. The wireless communication device of claim 14, wherein the plurality of dipoles each have an electrical length of less than one-quarter wavelength and are disposed orthogonal to an electric field of the multilayer package.

16. The wireless communication device of claim 13, wherein the impedance transformer is a coaxial impedance transformer including a plurality of vias, and wherein at least one of the plurality of vias is configured to couple the integrated circuit to one of the plurality of antenna feeds, through the one or more additional substrates, and wherein the impedance transformer is configured to match an impedance of a signal path, between the integrated circuit and the one of the plurality of antenna feeds, to one or more resonant frequencies.

17. The wireless communication device of claim 16, wherein the multilayer package is a subarray of a phased antenna array, the subarray including a plurality of subarray elements, wherein each subarray element includes one of the plurality of patch antennas, one of the plurality of slotted patch antennas, one of the plurality of antenna feeds, and a plurality of vias of the impedance transformer, one of the plurality of vias being configured to couple the integrated circuit to the one of the plurality of antenna feeds, through the one or more additional substrates.

18. The wireless communication device of claim 13, wherein the integrated circuit is configured to:

process radio frequency (RF) signals received by one or more patch antennas of the plurality of patch antennas; and process communication signals for transmission through one or more patch antennas of the plurality of patch antennas.

19. The wireless communication device of claim 13, wherein the integrated circuit is configured to:

receive RF signals from one of the plurality of patch antennas through one of the plurality of slotted patch antennas, one of the plurality of antenna feeds, and the impedance transformer; and transmit RF signals to one of the plurality of patch antennas through the impedance transformer, one of the plurality of antenna feeds, and one of the plurality of slotted patch antennas.

20. The wireless communication device of claim 13, wherein the plurality of patch antennas, the plurality of slotted patch antennas, the plurality of antenna feeds, the impedance transformer, and the integrated circuit are configured to operate in a millimeter wave (mmWave) frequency band.

21. The wireless communication device of claim 13, further comprising baseband processing circuitry to provide baseband signals to the integrated circuit.

* * * * *